US009719330B2

(12) United States Patent
Jaffrey

(10) Patent No.: US 9,719,330 B2
(45) Date of Patent: Aug. 1, 2017

(54) SUBSEA EQUIPMENT PENDULUM ARRESTOR AND METHOD FOR ITS USE

(71) Applicant: Cameron International Corporation, Houston, TX (US)

(72) Inventor: Andrew Jaffrey, Oldmeldrum (GB)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/980,042

(22) Filed: Dec. 28, 2015

(65) Prior Publication Data

US 2017/0183939 A1 Jun. 29, 2017

(51) Int. Cl.
*E21B 33/035* (2006.01)
*E21B 33/064* (2006.01)
*E21B 41/00* (2006.01)

(52) U.S. Cl.
CPC ..... *E21B 41/0007* (2013.01); *E21B 33/035* (2013.01); *E21B 33/064* (2013.01)

(58) Field of Classification Search
CPC ... E21B 41/0007; E21B 33/035; E21B 33/064
See application file for complete search history.

(56) References Cited

U.S. PATENT DOCUMENTS 3,215,202 A * 11/1965 Pollard ..... E21B 41/0014 166/341
3,265,130 A * 8/1966 Watkins ..... E21B 33/038 166/342
3,458,853 A * 7/1969 Daniels ..... E21B 41/0014 166/341
3,731,263 A * 5/1973 Daniels ..... E21B 41/0014 367/113
4,031,544 A * 6/1977 Lapetina ..... B63C 11/48 166/341
4,214,842 A * 7/1980 Franks ..... E21B 43/017 166/341
4,657,116 A * 4/1987 Gardner ..... F16F 15/00 114/312
4,730,677 A * 3/1988 Pearce ..... E21B 17/015 166/345
6,276,625 B1 * 8/2001 Chee ..... G06Q 40/04 114/312
6,343,655 B1 * 2/2002 Thomas ..... E21B 7/043 166/339
6,588,985 B1 * 7/2003 Bernard ..... B63B 21/22 166/338
6,685,394 B1 * 2/2004 Allen ..... B63B 9/02 114/243
7,066,686 B2 * 6/2006 Sabri ..... E21B 19/002 166/341

(Continued)

*Primary Examiner* — Matthew R Buck
(74) *Attorney, Agent, or Firm* — Gable Gotwals

(57) ABSTRACT

An apparatus for, and method of, reducing a pendulum motion of a piece of subsea equipment during a landing operation includes a frame assembly arranged for connection to the piece of subsea equipment; a sheet of arrestor material disposed within a perimeter of the frame assembly, and a drive mechanism arranged to move the sheet of arrestor material between a first position and a second position, each position providing a different amount of surface area than the other to create a different drag force on the equipment.

20 Claims, 8 Drawing Sheets

(56) References Cited

U.S. PATENT DOCUMENTS

| | | | | |
|---|---|---|---|---|
| 8,305,227 | B2 * | 11/2012 | Jaffrey | H04B 13/02 340/850 |
| 8,523,492 | B2 * | 9/2013 | Baugh | B63B 21/502 114/243 |
| 9,010,431 | B2 * | 4/2015 | Billington | E21B 19/002 166/250.01 |
| 9,080,393 | B2 * | 7/2015 | Wishahy | E21B 17/01 |
| 9,404,347 | B1 * | 8/2016 | Bjerga | E21B 43/013 |
| 2007/0272414 | A1 * | 11/2007 | Palmer | E21B 17/01 166/367 |
| 2009/0056936 | A1 * | 3/2009 | McCoy, Jr. | E21B 19/002 166/250.01 |
| 2014/0076483 | A1 * | 3/2014 | Pirie | B29C 63/14 156/187 |
| 2016/0201407 | A1 * | 7/2016 | Haugom | E21B 41/04 166/367 |
| 2016/0319798 | A1 * | 11/2016 | Blodgett | F03B 13/262 |

* cited by examiner

SUBSEA EQUIPMENT PENDULUM ARRESTOR AND METHOD FOR ITS USE

BACKGROUND

This section is intended to introduce the reader to various aspects of art that may be related to various aspects of the present disclosure, which are described or claimed below. This discussion is believed to be helpful in providing the reader with background information to facilitate a better understanding of the various aspects of the present disclosure. Accordingly, it should be understood that these statements are to be read in this light, and not as admissions of prior art.

This disclosure relates to systems, apparatuses and methods of aligning and connecting mating elements of subsea equipment and to wellhead connectors or to other subsea equipment when being suspended by a riser, wire, or cable (or their equivalents) and lowered into position.

Referring to FIGS. 1 & 2, the final stage of landing a blowout preventer ("BOP") stack assembly onto a wellhead can take several hours if the assembly is swinging on the riser in pendulum fashion, moving laterally and radially with respect to the wellhead. While prior art compensation systems on the deploying vessel provide the assembly a degree of vertical stability, the lateral and radial movements can cause significant delays in landing and connecting a BOP to a wellhead owing to the need to align the mating elements of the connector.

Similarly, landing and latching a lower marine riser package ("LMRP") to the lower BOP stack after a disconnect can be delayed while the correct alignment between the two is being achieved.

Both of these situations represent non-productive time and, therefore, have financial implications beyond the cost of the landing and disconnect operations. Shortening the time taken to align the mating elements of BOPs and wellhead connectors represents an opportunity to reduce the costs associated with the operation. Therefore, a need exists for systems and methods that dampen and reduce the pendulum effect of a BOP swinging on a riser and allow for easier alignment and make-up of the connectors.

SUMMARY

This summary is provided to introduce a selection of concepts thai are further described below in the detailed description. This summary is not intended to identify key or essential features of the claimed subject matter, nor is it intended to be used as an aid in determining or limiting the scope of the claimed subject matter as set forth in the claims.

An apparatus for reducing a pendulum motion of a piece of subsea equipment being vertically suspended and lowered in a body of water to a desired landing location includes a frame assembly arranged for connection to the piece of subsea equipment, a sheet of arrestor material disposed within a perimeter of the frame assembly; and a drive mechanism arranged to move the sheet of arrestor material between a first position providing a first amount of surface area and a second position providing a second different amount of surface area. The piece of subsea equipment could be a blowout preventer "(BOP") or a lower marine riser package ("LMRP").

The sheet of arrestor material can be wound about a bobbin and can be a continuous (surface area) sheet or a discontinuous sheet that includes flow-through areas. The drive mechanism can be arranged to be operated by a torque tool of a remote operated vehicle ("ROV") or autonomous underwater vehicle ("AUV") being used to actuate the drive. In a embodiment, the drive mechanism includes a rack-and-pinion gear arrangement that winds or unwinds the arrestor material and actuates a sliding roller to provide tension on the material during all stages of deployment. A stiffening member can be added and the bottom end of the arrestor material can be connected to vertical chains of the drive mechanism in order to provide positive deployment force on the material.

One or more pendulum motion sensors can be connected to the frame assembly and used in conjunction with a control and drive system to cause movement of the arrestor material to a new position or to maintain the material in its current position. At least one of the pendulum motion sensors can be an accelerometer.

A method of reducing a pendulum motion of a piece of subsea equipment being vertically suspended and lowered in a body of water to a desired landing location includes the step of creating a drag force on the piece of subsea equipment by moving a sheet of arrestor material between a first position and a second position, the first and second positions each covering a different amount of surface area relative to a side of the piece of subsea equipment. A second drag force can be created by actuating a second pendulum arrestor substantially the same as the first arrestor but arranged on another side of the piece of subsea equipment.

The drag force step can occur in all stages of the landing process or be limited to the final landing stage. Moving the arrestor material between various positions can be performed by a torque tool of an ROV or AUV.

The method can also include the steps of receiving a signal from a sensor, such as an accelerometer, arranged to detect the pendulum motion and then maintaining the drag force or, optionally, creating a new drag force in response to the signal. The sheet of arrestor material can be within a perimeter of a frame assembly that is connected to the piece of subsea equipment and sized so that it provides a maximum desired surface area (and therefore drag force) when in a fully opened position. The apparatus may also be included as an integral part of the subsea equipment or connected to it with brackets or their equivalent.

Objectives of this invention include providing an apparatus and method of reducing pendulum motion that (1) reduces the amount of time taken to align mating components during the final stages of a landing operation; (2) can be easily retrofitted to existing subsea equipment frames; (3) can be deployed using prior art ROVs, AUVs, and torque tools; and (4) does not require sophisticated control schemes to be effective.

BRIEF DESCRIPTION OF THE DRAWINGS

FIG. 5 is a front elevation view of the pendulum arrestor of FIG. 3 located on the aft side of the parent frame in a fully deployed position, covering that face or side of the parent frame. The sheet of material used for the arrestor can be a discontinuous sheet as shown in FIGS. 5 and 10 or a continuous sheet as shown in FIGS. 9 and 12.

Figure 1:
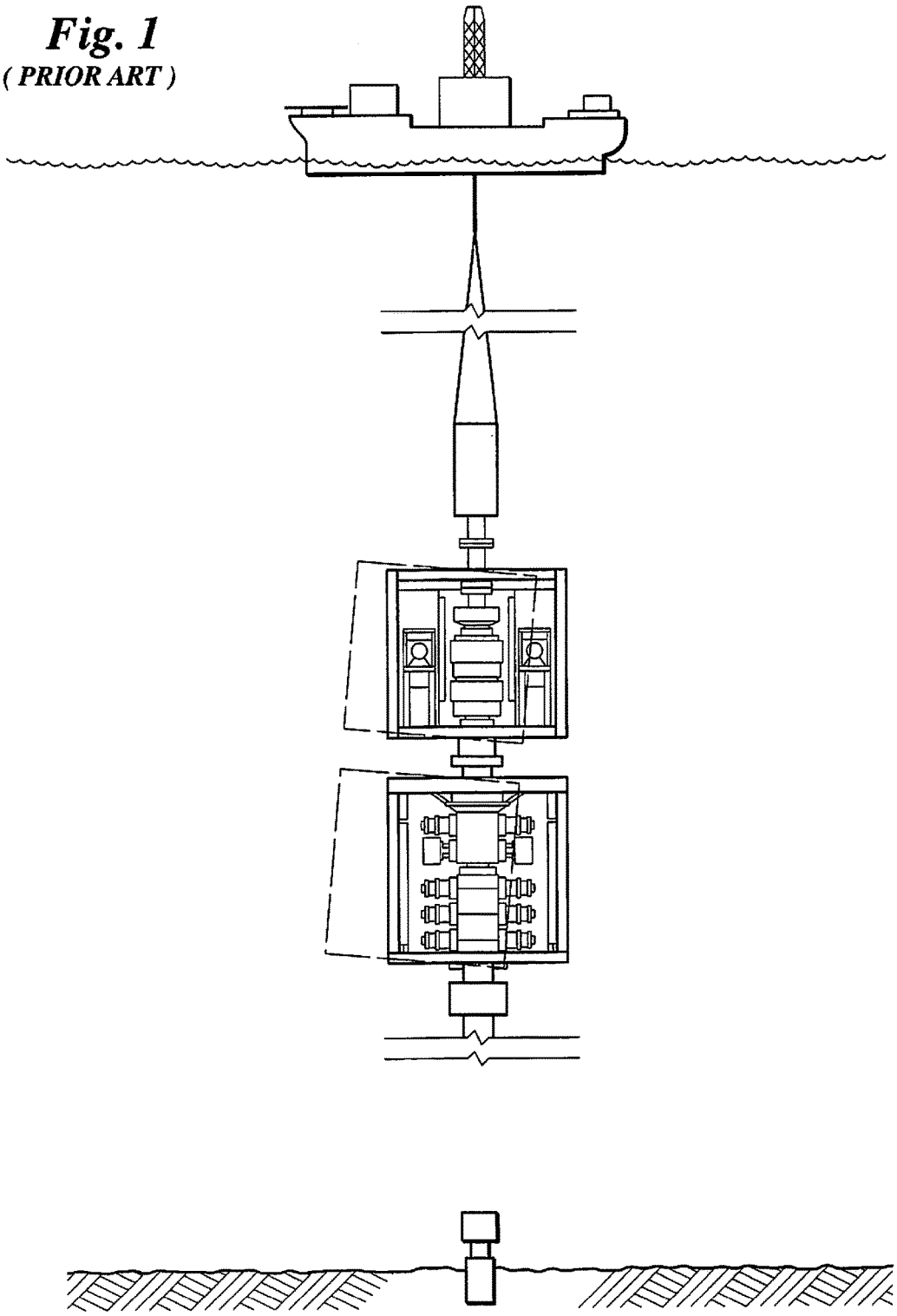
Fig. 1 ( PRIOR ART )
FIG. 1 is a conceptual diagram illustrative of a pendulum effect experienced by a blowout preventer ("BOP") as it swings on a riser during its final landing stage for connection to a wellhead or by a lower marine riser package ("LMRP") as it swings on a riser prior to its connection to the BOP (connected to the wellhead) following a disconnect operation.
Figure 2:
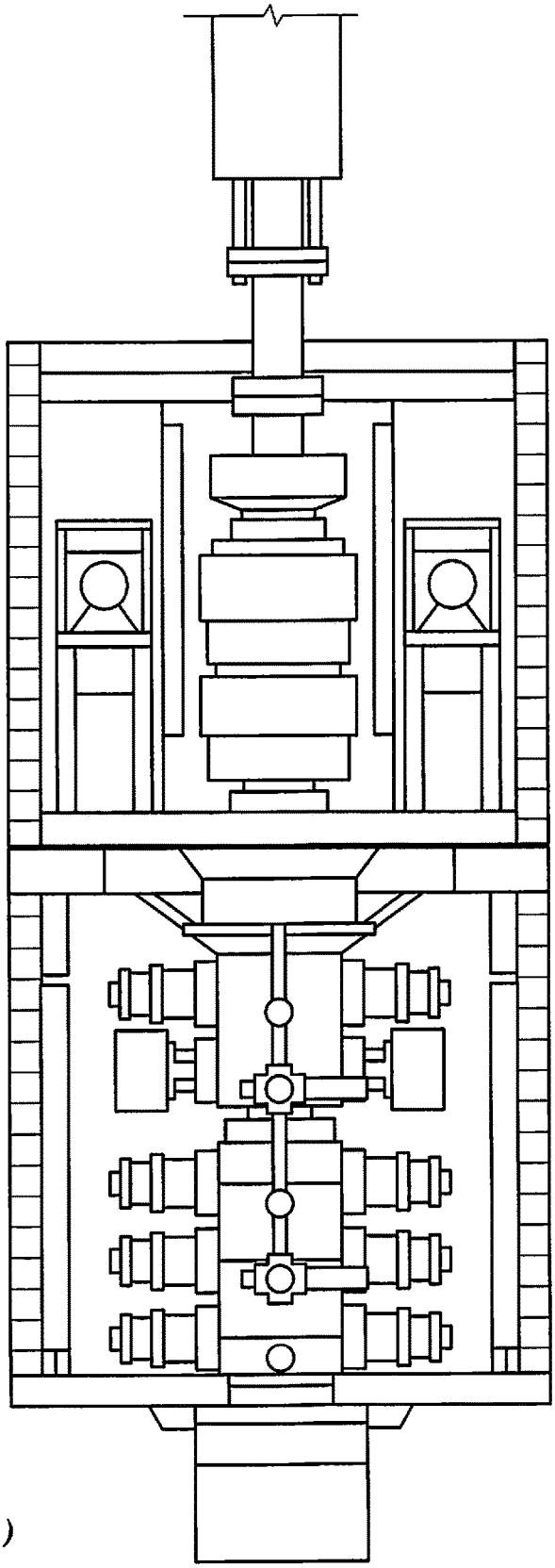
Fig. 2 ( PRIOR ART )
FIG. 2 is a front elevation view of the BOP and LMRP of FIG. 1 and the open-face or open-side "parent" frame that surrounds each.
Figure 3:
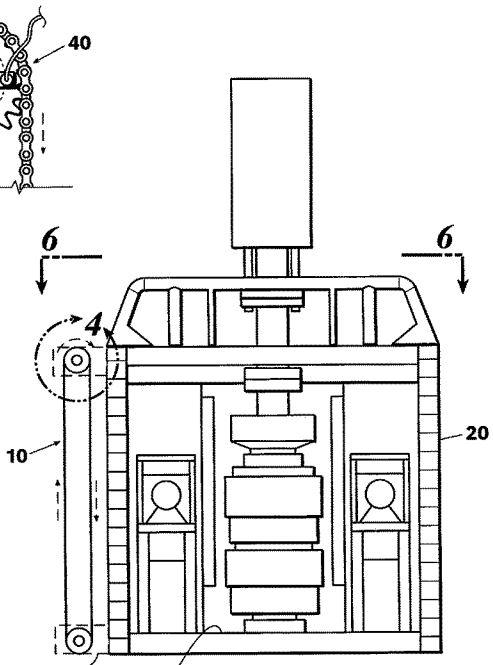
FIG. 3 is a side elevation view of a embodiment of a pendulum arrestor connected to the parent frame of an LMRP. The arrestor can be attached to one or more sides of the frame (see e.g.
Figure 4:
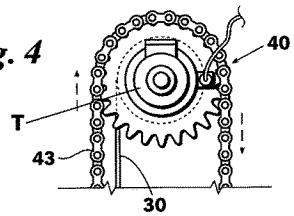
FIG. 4 is a detail view taken along section 4 of FIG. 3. A gear drive can be used to actively extend or retract the pendulum arrestor material between a fully retracted and a fully extended position. A feedback control system can be included to extend or retract the pendulum arrestor material in response to signals from accelerometers connected to the frame. A torque tool of a remote operated or autonomous underwater vehicle ("ROV" or "AUV") can be used to actuate the drive mechanism.

The subject disclosure is further described in the following detailed description, and the accompanying drawing and schematic of non-limiting embodiment of the subject disclosure. The features depicted in the figure are not necessarily shown to scale. Certain features of the embodiments may be shown exaggerated in scale or in somewhat schematic form, and some details of elements may not be shown in the interest of clarity and conciseness.

NUMBERING AND ELEMENTS USED IN THE DRAWING FIGURES

10 Pendulum arrestor
15 Motion sensors or pendulum motion sensors
20 Parent frame of subsea equipment assembly
21 Perimeter of planar side or face 23
23 Planar side or face of 20 or 25
25 Child frame connectable to 20
27 Bracket or coupler
29 Guide rails or channels
30 Sheet of drag or arrestor material
31 Top end
33 Bottom end
35 Edges or sides
37 Open or flow through areas
39 Vertical face or vertical face surface area
40 Drive mechanism
41 Gear box
42 Torque tool interface
43 Chain
45 Sprocket
47 Chain
49 Rack and pinion
50 Tensioning apparatus
55 Sliding or support roller
57 Fixed roller
60 Bobbin or winder
80 Stiffening member
81 End
T ROV or AUV torque tool

DETAILED DESCRIPTION

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

A pendulum arrestor as described and illustrated in this application provides a surface area effective to create drag to act as a form of a brake and counteract the swing of a piece of subsea equipment on its riser during a landing operation. For example, the pendulum arrestor could be used with a blowout preventer ("BOP") during its landing for connection to a wellhead or with a lower marine riser package ("LMRP") during its landing for connection to the BOP following a disconnect operation.

The pendulum arrestor includes a sheet of drag or arrestor material that can be deployed and retracted to provide a different surface area and, therefore, a drag force as needed. Deployment and retraction can occur under manual direction using several types of power source including hydraulic motor, electric motor and remote-operated or autonomous underwater vehicle ("ROY" or "AUV") torque tool. The creation of surface area perpendicular to the direction of motion of the subsea equipment will cause a significant drag effect that in turn will counter the pendulum effect of the equipment on its riser and dampen the motion. A feedback control system can be included to extend or retract the pendulum arrestor in response to signals from sensors such as accelerometers connected to the subsea equipment.

Embodiments of a method of reducing the pendulum motion include the step of creating a drag force on the piece of subsea equipment by moving a first sheet of arrestor material between a first position and a second position, the first and second positions each exposing a different amount of vertical surface area of the sheet of arrestor material relative to a first side of the piece of subsea equipment. A second drag force on the piece of subsea equipment can be created by moving a second sheet of arrestor material between a first and a second position, with the second sheet of arrestor material being arranged on a second side of the piece of subsea equipment. The second side can be orthogonal to the first side and the second sheet of arrestor material can be identical to, or different than, the first sheet of arrestor material (e.g. both continuous sheets, both discontinuous sheets, or one continuous and the other discontinuous).

The method can also include the steps of receiving a signal from a sensor arranged to detect the pendulum motion and, creating, in response to the signal, a different drag force on the piece of subsea equipment by moving the sheet of arrestor material into a third position. This can be accomplished for the second sheet (or other sheets) of arrestor material as well. The drag force being created by the arrestor material can occur throughout all stages of landing the piece of equipment or during its final landing stage.

Embodiments of an apparatus used in practicing the method includes a pendulum arrestor made up of a frame assembly arranged for connection to the piece of subsea equipment, a sheet of arrestor material disposed within a perimeter of the frame assembly, and a drive mechanism arranged to move the sheet of arrestor material between a first position and a second position, the first position and second positions exposing a different amount of vertical surface area of the sheet of arrestor material. One or more pendulum motion sensors can be connected to the frame assembly with the drive mechanism being in communication with the sensors. The first position can be the fully retracted position and the second position can be the fully deployed position, with the drive mechanism capable of placing the sheet of arrestor material into intermediate positions between the two. A second pendulum arrestor can be placed on an orthogonal or opposite side of the subsea equipment relative to the first pendulum arrestor.

The sheet of arrestor material, which can be a continuous or discontinuous sheet, can include one or more stiffening members located across a width of the sheet. The frame assembly can include a pair of guide channels arranged on opposite sides of the frame assembly, each guide channel arranged to receive a respective side portion of the sheet of arrestor material. The drive mechanism, which can be actuated by a torque tool of an underwater vehicle, can include a pair of vertical chains with at least a portion of the sheet of arrestor being connected to the vertical chains.

In embodiments, the drive mechanism includes a rack-and-pinion gear arrangement that actuates a fabric bobbin to wind or unwind the sheet of arrestor material and moves a sliding roller in a horizontal direction to maintain tension on the sheet as it is being wound or unwound. A fixed roller arranged across a width of the sheet is also in constant contact with the sheet of arrestor material.

Referring to FIGS. 3 to 6, a pendulum arrestor 10 includes a sheet of drag or arrestor material 30 and an associated drive mechanism 40. The arrestor material 30 can be any type preferable. For example, a woven polypropylene material or its equivalent provides a suitable arrestor material 30.

Pendulum arrestor 10 is arranged on one or more planar sides or faces 23 of a "parent" frame 20 that surrounds a LMRP, with each side 23 lying opposite a respective side or face of the BOP. For example, in one embodiment, pendulum arrestor 10 is on only one side 23 of frame 20 such as the port side. In another embodiment, the pendulum arrestor 10 is on two mutually perpendicular sides 23 such as the port and aft sides, thereby allowing movement in either principle direction to be damped. In yet another embodiment, the pendulum arrestor 10 is on all sides 23. The pendulum arrestor can be mounted on or within the perimeter 21 of the side 23 to substantially cover the same area as the side 23 or it can extend beyond the perimeter 21.

Each pendulum arrestor 10 could be a separate unit or assembly mounted on or within a perimeter 21 of its own "child" frame 25 that is connectable to (and demountable from) parent frame 20 or the subsea equipment assembly (e.g., LMRP or BOP stack). The child frame 25 is a frame that houses the arrestor 10, is constructed to match an opposing side of the parent frame 20, and is connectable to the frame 20 by a set of brackets or disconnect couplers 27. The use of easily disconnected couplers such as ball and taper units or their equivalent allows the frame 25, and therefore the pendulum arrestor 10, to be detached by an ROV or AUV tool "T" and winched to a surface vessel if necessary for such things as repair, maintenance, or when the arrestor 10 is no longer required.

Similar to the parent-frame embodiment, the child frame 25 could be sized larger than that of the side 23 of the opposing parent frame 20 to extend the surface area of the pendulum arrestor 10 beyond the dimensions of that side 23 to create more surface area and, therefore, increase drag. Or, the child frame 15 could be sized smaller than that of the opposing side 23 of the parent frame 20 to provide less surface area when the arrestor material 30 is in the fully extended position.

Multiple child frames 25 could be sized and arranged about the parent frame 20 so that collectively the frames 25 form a hexagon or octagon shape (or any other shape preferable) about the parent frame to provide even greater control over any pendulum effect. However, beyond-square arrangements increase the overall footprint and may present a more difficult control problem.

The arrestor material 30 provides an amount of surface area between its upper and lower ends 31, 33 and sides 35. The material 30 is preferably flexible enough that can be moved in "roller-blind" or "window-shade" fashion between a fully retracted or first position (completely exposing side 23) and a fully extended or second position (completely covering side 23) as needed. In this way, the arrestor material 30 can present a same or different amount of vertical face surface area 39 at different times relative to its respective side 13 or relative to the arrestor material 30 on another side 23. For example, the arrestor material 30 on the port-side pendulum arrestor 10 can be fully deployed while the arrester material 30 on the aft-side pendulum arrestor 10 is fully retracted or only partially deployed. Other combinations can be used depending on the pendulum motion being encountered during the landing process or anticipated to be encountered.

Additionally, the pendulum arrestor 10 on a side 23 can assume one deployment configuration during one stage of the landing operation and an entirely different deployment configuration during another stage of the operation. As the material 30 moves between a fully retracted and a fully deployed position, a different amount of surface area 39, and therefore a different amount of drag, is presented to act as a brake and dampen (or prevent) any pendulum motion.

Figure 5:
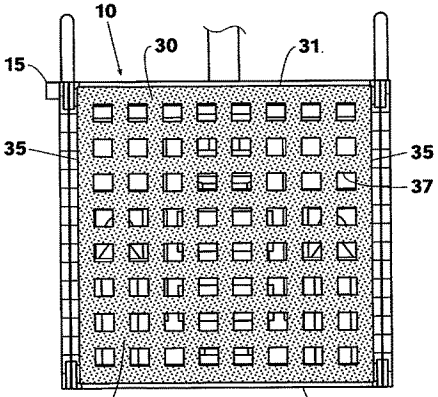
FIG. 5) and present a surface area perpendicular to a direction of motion of the LMRP.
Figure 6:
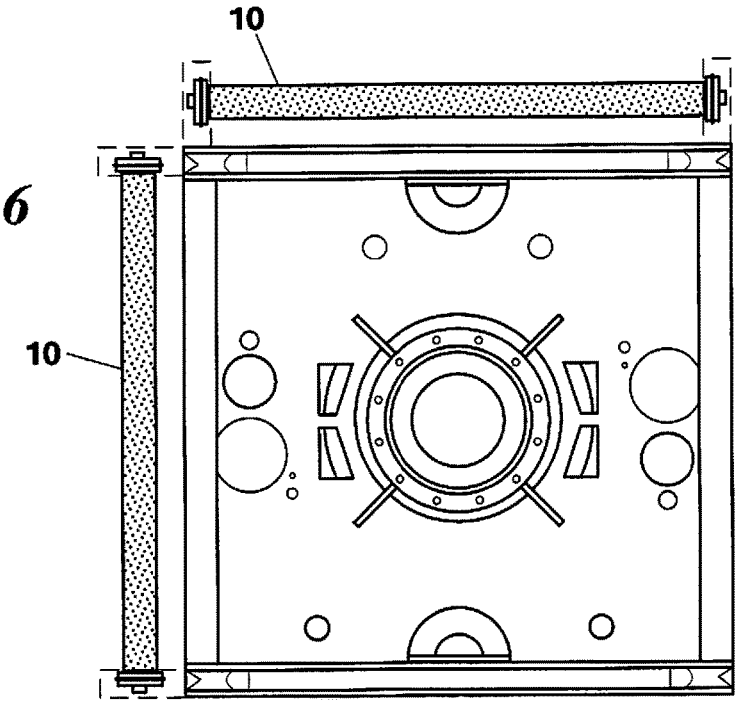
FIG. 6 is a top plan view of the pendulum arrestor taken along section line 6-6 of FIG. 3. Pendulum arrestors can be attached to one or more sides of the parent frame and present a surface area perpendicular to a direction of motion of the subsea equipment that causes a significant drag effect which counters the pendulum effect and dampens the motion. The arrestor is shown here on opposing sides for illustrative purposes but can be arranged on one side only, two perpendicular sides (e.g. port and aft), or all four sides.
Figure 7:
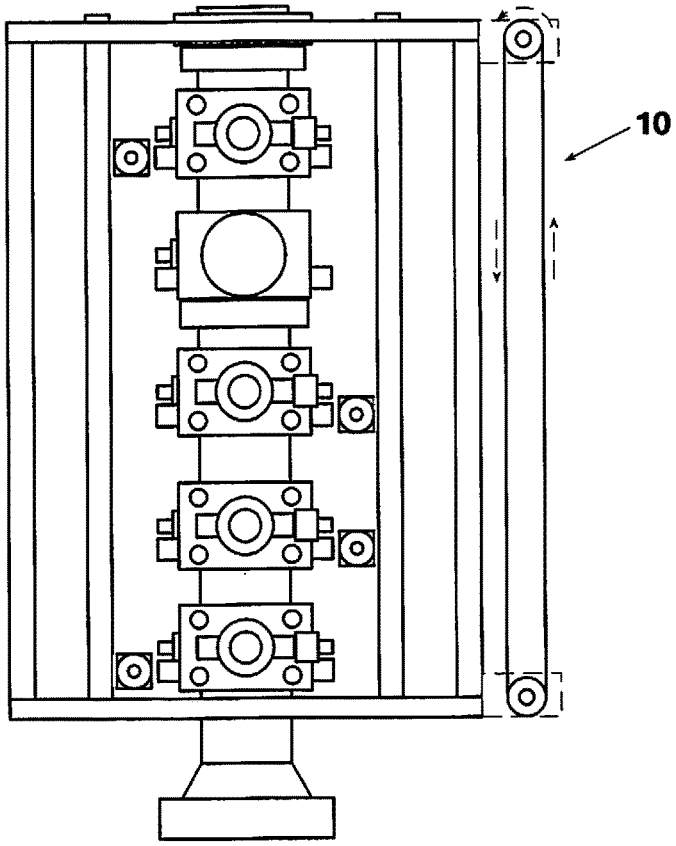
FIG. 7 is a side elevation view of a embodiment of a pendulum arrestor connected to the parent frame of a BOP stack in a same arrangement as that of FIG. 6.
Figure 8:
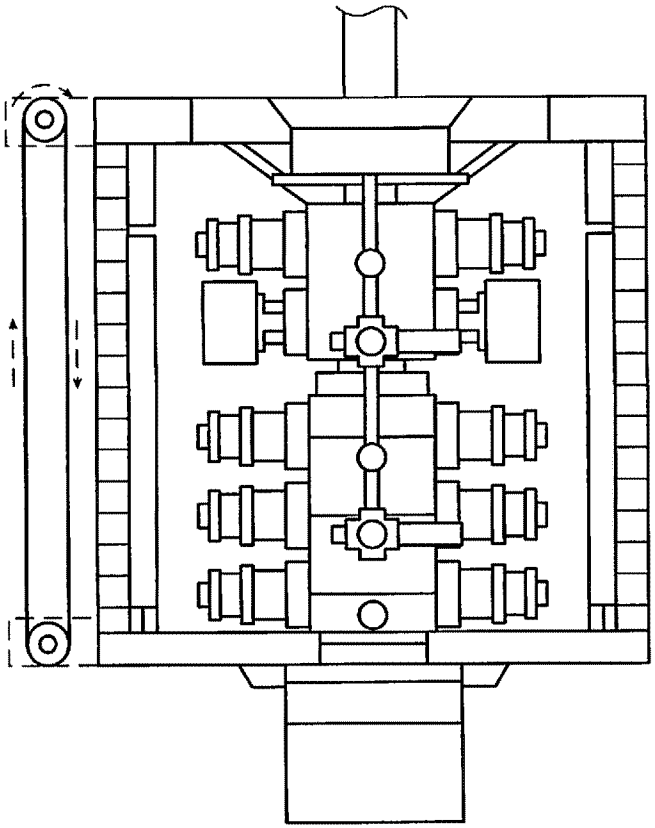
FIG. 8 is a side elevation view of the pendulum arrestor of FIG. 7.
Figure 9:
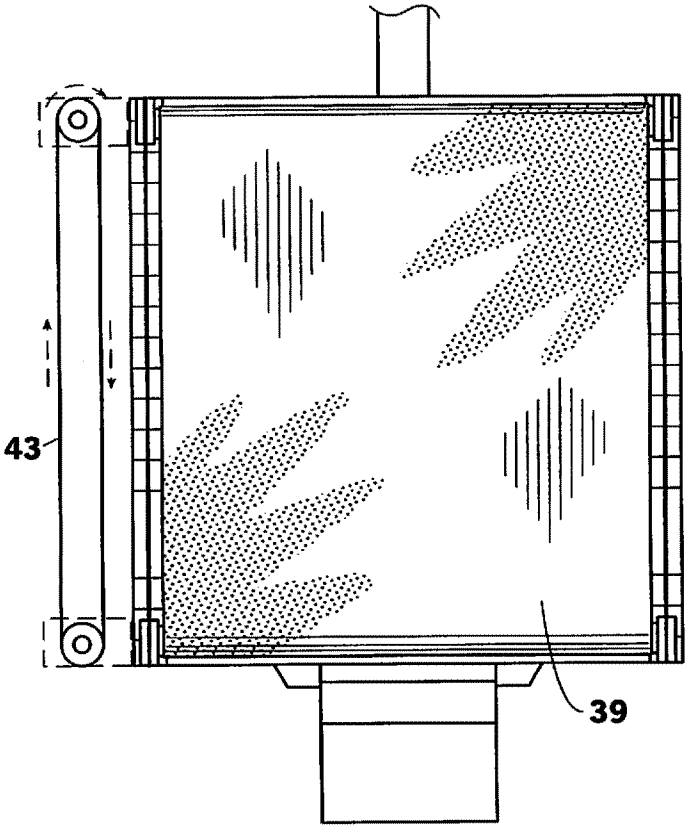
FIG. 9 is a side and front elevation view of the pendulum arrestor of FIG. 7 in a fully deployed position to present maximum surface area and drag. The sheet of material used for the arrestor can be a continuous sheet as shown in FIGS. 9 and 12 or a perforated sheet as shown in FIGS. 5 and 10 to allow restricted flow. If used on more than one side of the frame, the arrestor material on one side could be a same or different kind of sheet than the material used on another side.
Figure 10:
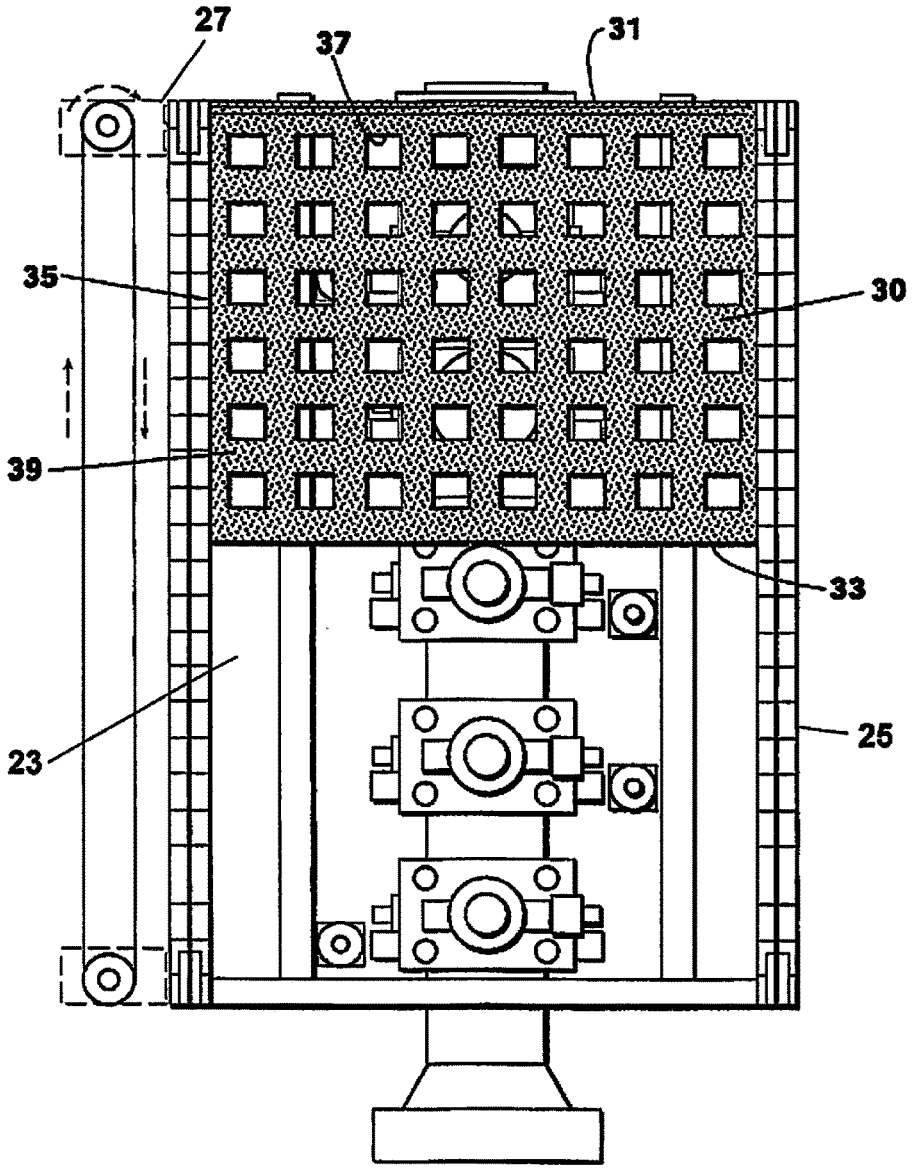
FIG. 10 is a side and front elevation view of the pendulum arrestor of FIG. 7 with a different embodiment of the arrestor material located on the aft side of the parent frame in a partially deployed position, covering that face or side of the parent frame. The sheet of material used for the arrestor can be a perforated sheet as shown in FIGS. 5 and 10 to allow restricted flow or a continuous sheet as shown in FIGS. 9 and 12.
Figure 12:
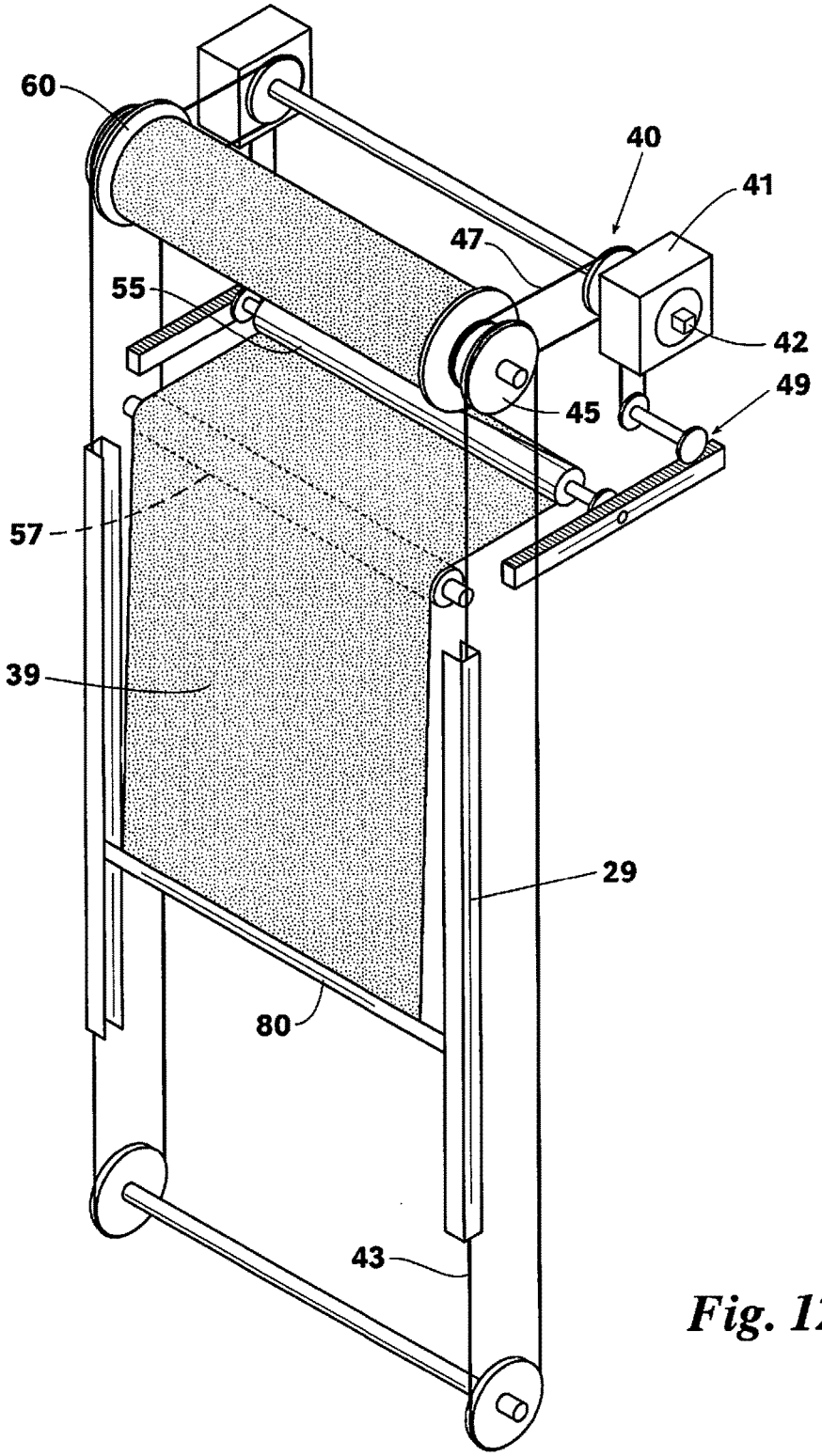
FIG. 12 is an isometric view of the drive mechanism of FIG. 11.

Arrestor material 30 can be either in the form of a continuous sheet having a continuous surface area 39 (see e.g. FIGS. 9 & 12) or a discontinuous sheet having openings or flow-through areas 37 that provide restricted flow through the sheet 30 (see e.g. FIGS. 5 & 10). The drag effect is less pronounced with the discontinuous sheet and, therefore, less likely to rip arrestor material 30 out of its supporting frame 20 or 25 or damage the drive mechanism 40. Regardless of whether the material 30 is a continuous or discontinuous sheet, stiffeners 80 can be used to provide added strength and to reduce or eliminate billowing effects.

Figure 11:
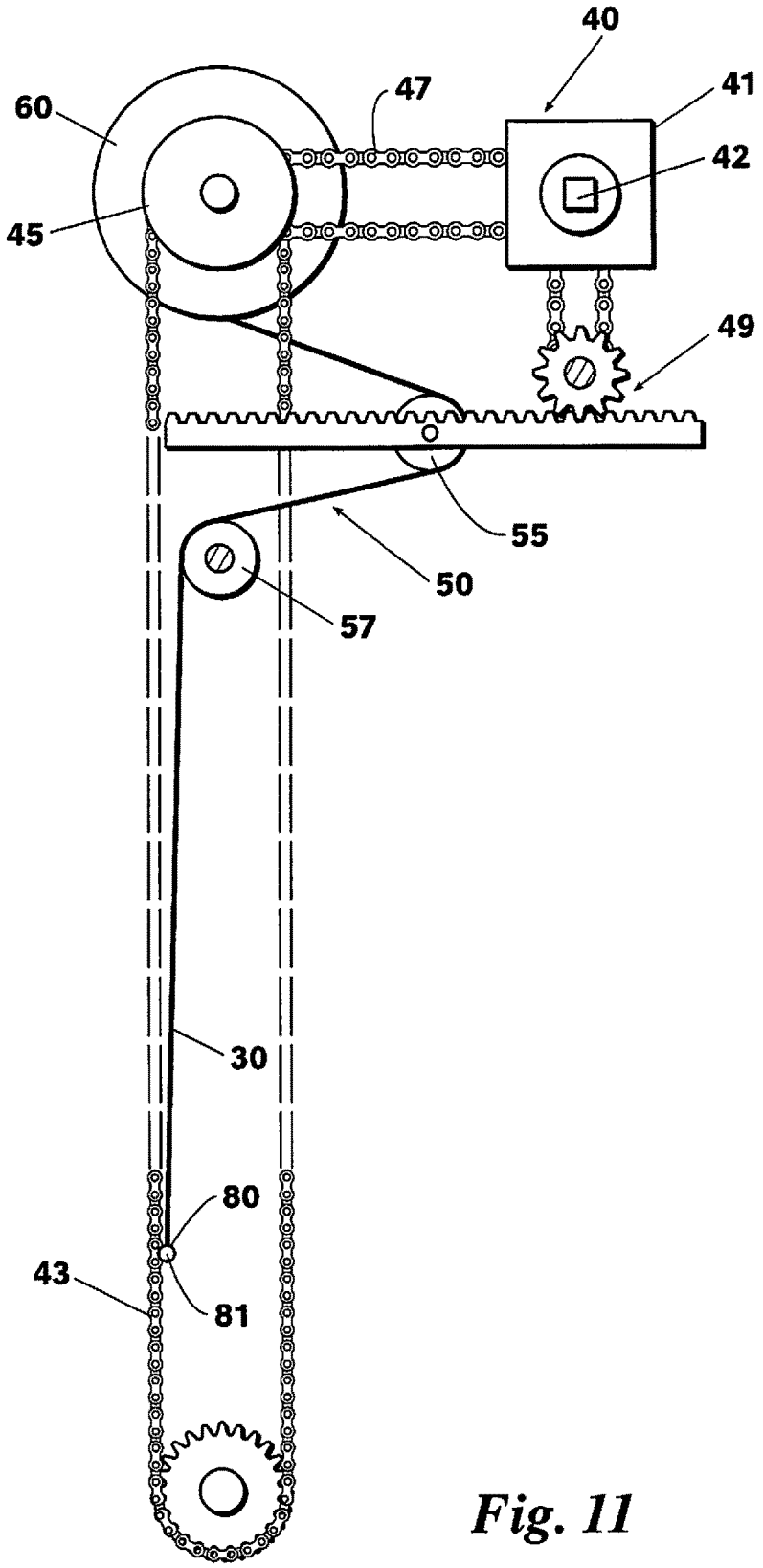
FIG. 11 is a side elevation view of an embodiment of a drive mechanism of the pendulum arrestor. The drive mechanism includes a rack-and-pinion arrangement that engages a sliding roller to help maintain tension on the arrestor material during deployment and retraction. For illustration purposes, the arrestor material is shown slightly off vertical relative to the guide channels or rails (see FIG. 12). Preferably, the sides of arrestor material ride in the guide channels along with the chain.

A drive mechanism 40 is used to move the arrestor material 30 between a first position (which could be the fully retracted position), a second position (which could be a partially extended or fully extended position), and positions in-between these two positions, with each position representing a different amount of vertical face surface area 39 being deployed or presented by the material 30. In one embodiment, drive mechanism 40 is a drive gear, sprocket, and chain arrangement (see FIGS. 4, 11 & 12).

Operation of the drive mechanism 40 can occur by an on-board motor (not shown) integral to the pendulum arrestor 10. A feedback control system can be included to actively extend or retract the arrestor material 30 in response to signals from pendulum, motion sensors 15 such as accelerometers connected to the BOP. This control system could be installed topside or locally on the BOP to allow autonomous operation. Or, operation of the drive gear mechanism 40 can occur by docking one or more ROVs (or AUVs) and engaging the ROV's torque tool T with a torque tool interface 42 of the drive mechanism 40.

In embodiments of the drive mechanism 40, a gear box 41 drives a pair of chains 47 that are connected to a sprocket 45 of a bobbin 60 on which the arrestor material 30 is wound. The sprocket 45 in turn drives a pair of chains 43 to which a bottom end 33 or other portion of the arrestor material 30 is attached. The gear box 41 also drives a rack and pinion 49 that operates a tensioning apparatus 50. Tensioning apparatus 50 keeps the arrestor material 30 in tension at all stages of deployment.

The diameter of the sprocket 45 is sized such that when the arrestor material 30 is fully unwound (meaning fully deployed), the material 30 is under tension to ensure that the drag force is maximized. During the first rotations of the bobbin 60, the effective diameter of the material 30 is greater than that of the sprocket 45. Therefore, the arrestor material 30 will unroll faster than the chains 43 move vertically. The tensioning apparatus 50 takes up this slack in the material 30.

The tensioning apparatus 50 may include a sliding or support (tensioning) roller 55 that stretches across the full width of the arrestor material 30 and moves linearly toward and away from the vertical plane of the material 30. The sliding roller 55 is affixed to the rack gear of a rack and pinion 49 so that when the rack gear moves, the roller 55 moves linearly. (Instead of the rack-and-pinion 49 arrangement, a simple spring arrangement could also be used to provide the necessary force.) As the main drive mechanism 40 is turned, a series of intermediate gears in gear box 41 converts the rotation to a lower gearing, i.e. fewer turns, and in turn drives the linear position of the sliding roller 55 toward or away from the vertical face 39 of the arrestor material 30.

When the arrestor material 30 is fully wound-on the bobbin 60, the sliding roller 55 will be positioned in-board of the main frame 20 (offset with respect to the deployed vertical plane of the arrestor material 30). Again, with each rotation of the bobbin 60 to deploy the material 30, the sliding roller 55 moves towards the vertical face 39 of the material 30, thus reducing the amount of tension applied because there will be less slack to be taken-up. A roller 57 in a fixed position and spanning the width of the arrestor material 30 aligns the material 30 with the face of the subsea equipment. The material 30 can be fully retracted as required.

A stiffening member 80 is arranged horizontally across the bottom end 33 of the arrestor material 30, with the ends 81 of the stiffening member 80 engaged in (constrained by) the vertical guide rails or channels 29. The guide channels 29 (or grooves or an equivalent structure) can be sized to house and constrain the movement of the chains 43 and eliminate or reduce any billowing effect of the arrestor material 30. The stiffening member 80 or a portion of the arrestor material 30 is connected to the chains 43 in order to provide positive deployment force on the material 30.

Referring now to FIGS. 7 to 10, a pendulum arrestor 10 with arrestor material 30 is arranged on one or more planar faces or sides 23 of a parent frame 20 that surrounds BOP stack, each side 23 lying opposite a respective side of the BOP stack. Alternatively, the arrestor 10 can be arranged in a child frame 25. The structure and use of the arrestor 10 on the BOP includes the same options for deployment as that of the LMRP.

The embodiments discussed above provide examples of the pendulum arrestor. The scope of the invention is defined by the following claims and includes the full range of equivalents to which the recited elements are entitled.

The disclosure may be susceptible to various modifications and alternative forms, embodiment have been shown by way of example in the drawing and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for" or "step for" performing a function, it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A method of reducing a pendulum motion of a piece of subsea equipment being suspended vertically and lowered in a body of water to a desired landing location, the method comprising the step of:

creating a drag force on the piece of subsea equipment by moving a first sheet of arrestor material between a first position and a second position, the first and second positions each exposing a different amount of vertical surface area of the first sheet of arrestor material relative to a first side of the piece of subsea equipment.

2. A method according to claim 1 further comprising the step of creating a second drag force on the piece of subsea equipment by moving a second sheet of arrestor material between a first and a second position, the second sheet of arrestor material being arranged on a second side of the piece of subsea equipment.

3. A method according to claim 2 wherein the second sheet of arrestor material is orthogonal to the first sheet of arrestor material.

4. A method according to claim 2 wherein the second sheet of arrestor material is identical to the first sheet of arrestor material, said arrestor materials being selected from the group consisting of a continuous surface area sheet and a discontinuous surface area sheet.

5. A method according to claim 1 further comprising the steps of:

receiving a signal from a sensor arranged to detect the pendulum motion; and creating, in response to the signal, a different drag force on the piece of subsea equipment by moving the first sheet of arrestor material into a third position.

6. A method according to claim 1 wherein the creating drag force step occurs during a final landing stage of the piece of subsea equipment.

7. An apparatus for reducing a pendulum motion of a piece of subsea equipment being vertically suspended and lowered in a body of water to a desired landing location, the apparatus comprising:

a frame assembly arranged for connection to the piece of subsea equipment;

a sheet of arrestor material disposed within a perimeter of the frame assembly; and a drive mechanism arranged to move the sheet of arrestor material between a first position and a second position, the first position and second positions each exposing a different amount of vertical surface area of the sheet of arrestor material relative to a side of the piece of subsurface equipment.

8. An apparatus according to claim 7 further comprising the frame assembly including a pair of guide channels arranged on opposite sides of the frame assembly, each guide channel arranged to receive a respective side portion of the sheet of arrestor material.

9. An apparatus according to claim 7 further comprising the drive mechanism including a pair of vertical chains, at least a portion of the sheet of arrestor being connected to the vertical chains.

10. An apparatus according to claim 7 further comprising the drive mechanism being a rack-and-pinion gear arrangement.

11. An apparatus according to claim 7 further comprising the drive mechanism including a tensioning device in communication with the sheet of arrestor material.

12. An apparatus according to claim 11 further comprising the tensioning device including a sliding roller arranged across a width of the sheet of arrestor material, the sliding roller arranged to move a portion of the sheet of arrestor material linearly toward and away from vertical.

13. An apparatus according to claim 11 further comprising the tensioning device including a fixed roller arranged across a width of the sheet of arrestor material and located to be in constant contact with a portion of the sheet of arrestor material.

14. An apparatus according to claim 7 further comprising one or more pendulum motion sensors connected to the frame assembly.

15. An apparatus according to claim 14 further comprising the drive mechanism being in communication with the one or more pendulum motion sensors.

16. An apparatus according to claim 7 further comprising the sheet of arrestor material including a continuous surface area.

17. An apparatus according to claim 7 further comprising the sheet of arrestor material including flow-through areas.

18. An apparatus according to claim 7 further comprising the sheet of arrestor material including one or more stiffening members.

19. An apparatus according to claim 18 wherein the one or more stiffening members are located across a width of the sheet of arrestor material.

20. An apparatus according to claim 7 further comprising the drive mechanism including a torque tool interface arranged to receive a torque tool of an underwater vehicle.

* * * * *